US005462129A

United States Patent [19]

Best et al.

[11] Patent Number: 5,462,129

[45] Date of Patent: Oct. 31, 1995

[54] METHOD AND APPARATUS FOR EROSIVE STIMULATION OF OPEN HOLE FORMATIONS

[75] Inventors: Jim E. Best, Cochrane; Donald A. Smith, Innisfail, both of Canada

[73] Assignee: Canadian Fracmaster Ltd., Canada

[21] Appl. No.: 252,407

[22] Filed: Jun. 1, 1994

[30] Foreign Application Priority Data

Apr. 26, 1994 [CA] Canada ..... 2122163

[51] Int. Cl.[6] ..... E21B 7/18

[52] U.S. Cl. ..... 175/67; 166/222

[58] Field of Search ..... 166/222, 312, 166/305.1, 307; 175/67

[56] References Cited

U.S. PATENT DOCUMENTS

| | | | |
|---|---|---|---|
| RE 31,495 | 1/1984 | Zublin . | |
| 2,327,051 | 8/1943 | Lyons et al. | 166/222 |
| 2,329,157 | 9/1943 | Frack | 166/222 |
| 2,871,948 | 2/1959 | Normand . | |
| 2,997,108 | 8/1961 | Sievers et al. . | |
| 3,081,828 | 3/1963 | Quick | 175/67 |
| 3,100,542 | 8/1963 | Stark | 175/67 |
| 3,130,786 | 4/1964 | Brown et al. | 175/67 |
| 3,508,621 | 4/1970 | Gaylord et al. | 175/67 |
| 3,593,786 | 7/1971 | Lewis . | |
| 4,441,557 | 4/1984 | Zublin . | |
| 4,442,899 | 4/1984 | Zublin . | |
| 4,518,041 | 5/1985 | Zublin . | |
| 4,718,728 | 1/1988 | Hodges | 175/67 X |
| 4,850,440 | 7/1989 | Smet | 175/67 |
| 5,033,545 | 7/1991 | Sudol . | |
| 5,086,842 | 2/1992 | Cholet . | |

FOREIGN PATENT DOCUMENTS

| | | |
|---|---|---|
| 904172 | 7/1972 | Canada . |
| 956886 | 10/1974 | Canada . |
| 2074247 | 7/1991 | Canada . |
| 1301638 | 5/1992 | Canada . |

*Primary Examiner*—Ramon S. Britts
*Assistant Examiner*—Frank S. Tsay
*Attorney, Agent, or Firm*—Lerner, David, Littenberg, Krumholz & Mentlik

[57] ABSTRACT

There is described an improved apparatus and method of treating a section of unlined well bore comprising the steps of establishing a flow path from the top of the well bore to a location opposite the section of unlined well bore to be treated, pumping an erosive fluid through the flow path at a predetermined rate and pressure, directing a stream of the erosive fluid against a surface of the section of well bore to be treated to cause the initiation of a cut thereinto, and moving the stream of erosive fluid past a length of the surface to be treated to extend the cut formed therein in the direction of movement of the stream.

14 Claims, 5 Drawing Sheets

METHOD AND APPARATUS FOR EROSIVE STIMULATION OF OPEN HOLE FORMATIONS

FIELD OF THE INVENTION

The present invention relates to the stimulation of oil and gas wells and more particularly to an alternate apparatus and method for selectively treating open unlined well bores with skin damage by means of abrasive jetting of exposed formation surfaces.

BACKGROUND OF THE INVENTION

Increasingly, the drilling of oil and gas wells is no longer a matter of drilling vertical bore holes from the surface to a zone of hydrocarbon recovery using a bit attached to the bottom of discrete rotatable lengths of drill string. Technology and techniques have been developed to deviate the bore's trajectory at angles of up to and sometimes exceeding 90° from the vertical. In this way, significant economic zone enhancement can be achieved for example by creating a bore that actually follows an oil or gas bearing strata.

Unlike most vertical wells that are normally lined with casing to well bottom, horizontal bores are sometimes cased to just above the kickoff from the vertical section with the remainder of the well comprising unlined open hole formation. This poses well stimulation problems particularly if conventional acidizing or bleaching techniques are ineffective or inappropriate having regard to formation and formation fluid characteristics. Skin damage to the formation surrounding the horizontal or vertical bore can occur for example as a result of having been drilled with a polymer-based mud system, carbonate formations in particular being susceptible to contamination by polymers used in some drilling muds. Normal practice for skin damaged carbonate involves acid or bleach treatment. Bleach can be ineffective with respect to some polymers and acid washes, due to their depth of penetration, can open fractures to nearby water bearing formations.

Economic considerations also arise in that not all of the horizontal (or vertical) section penetrated by the bore will exhibit viable productivity traits. As a result, these sections are not economically susceptible of stimulation. Selective treatment of only portions of the bore will be preferred in such cases. Inflatable packers can be used to isolate portions for selective stimulation but sealing against an open bore is less reliable than sealing off sections of steel casing, nor is this approach conducive to controlling penetration rates beyond desirable limits.

Aromatic acids to break down paraffins and asphaltenes and an underbalanced acid wash and squeeze reduce penetration depths and reduce acid volumes required. However, for selective stimulation, packoffs will be required.

SUMMARY OF THE INVENTION

Applicant has discovered that high pressure abrasive jetting to erode away contaminated or damaged sections of formation, particularly in underbalanced conditions, offers numerous economic and functional advantages, including selective stimulation of desired intervals without packoffs, increased ability to control approximate depths of treatment penetration, the ability to maintain positive inflows of reservoir fluids to allow continuous monitoring and evaluation of the operation and the ability to clean the well bore during treatment as a result of the underbalanced conditions.

The operational safety and cost advantages of coiled tubing in well servicing operations, including stimulation and cleanouts, are well known, and applicant's method and apparatus as described herein have been adapted for this technology. Use of coiled tubing eliminates the need for a pressure development system otherwise required to control gasified fluids if conventional production tubing is used. In a preferred embodiment as taught herein, nitrogen is injected with the abrasive-laden fluid to create underbalanced conditions in the well. Moreover, the use of coiled tubing eliminates frequent tubing breaks otherwise required if the cutting tool is pulled across a substantial length of formation requiring selective stimulation, thereby shortening operating times, decreasing product quantities and reducing costs.

It is therefore an object of the present invention to provide a method and apparatus for erosive stimulation of open hole formation that obviates and mitigates from the disadvantages of the prior art.

It is a further object of the present invention to provide an apparatus that is self-orienting in a horizonal downhole environment.

It is a further object of a preferred embodiment of the present invention to provide a method of erosive stimulation combining the use of a gas to create an underbalanced condition in the well bore.

According to the present invention, then, there is provided a method of treating a section of unlined well bore comprising the steps of establishing a flow path from the top of the well bore to a location opposite the section of unlined well bore to be treated, pumping an erosive fluid through the flow path at a predetermined rate and pressure, directing a stream of the erosive fluid against a surface of the section of well bore to be treated to cause the initiation of a cut thereinto, moving the stream of the erosive fluid past a length of the surface to be treated to extend the cut formed therein in the direction of movement of the stream.

According to another aspect of the present invention, there is also provided apparatus adapted for connection to non-rotating coiled tubing for erosive cutting of an open unlined section of a well bore requiring treatment, comprising a tubular member connectable at one end thereof to coiled tubing and having at an opposite end thereof an opening for the passage of fluid, nozzle means provided on the tubular member for directing a pressurized erosive medium against a surface of a well bore for cutting into the surface, the nozzles means being arranged to avoid reactive forces causing the tubular member to rotate, means for moving the tubular member past a section of well bore requiring treatment such that the erosive medium forms an extended cut thereinto in the direction of movement of the tubular member, and means for sealing the opening in the tubular member prior to initiating flow of the pressurized erosive medium through the nozzles.

BRIEF DESCRIPTION OF THE DRAWINGS

Preferred embodiments of the present invention will now be described in greater detail and will be better understood when read in conjunction with the following drawings, in which.

DETAILED DESCRIPTION

Figure 1:
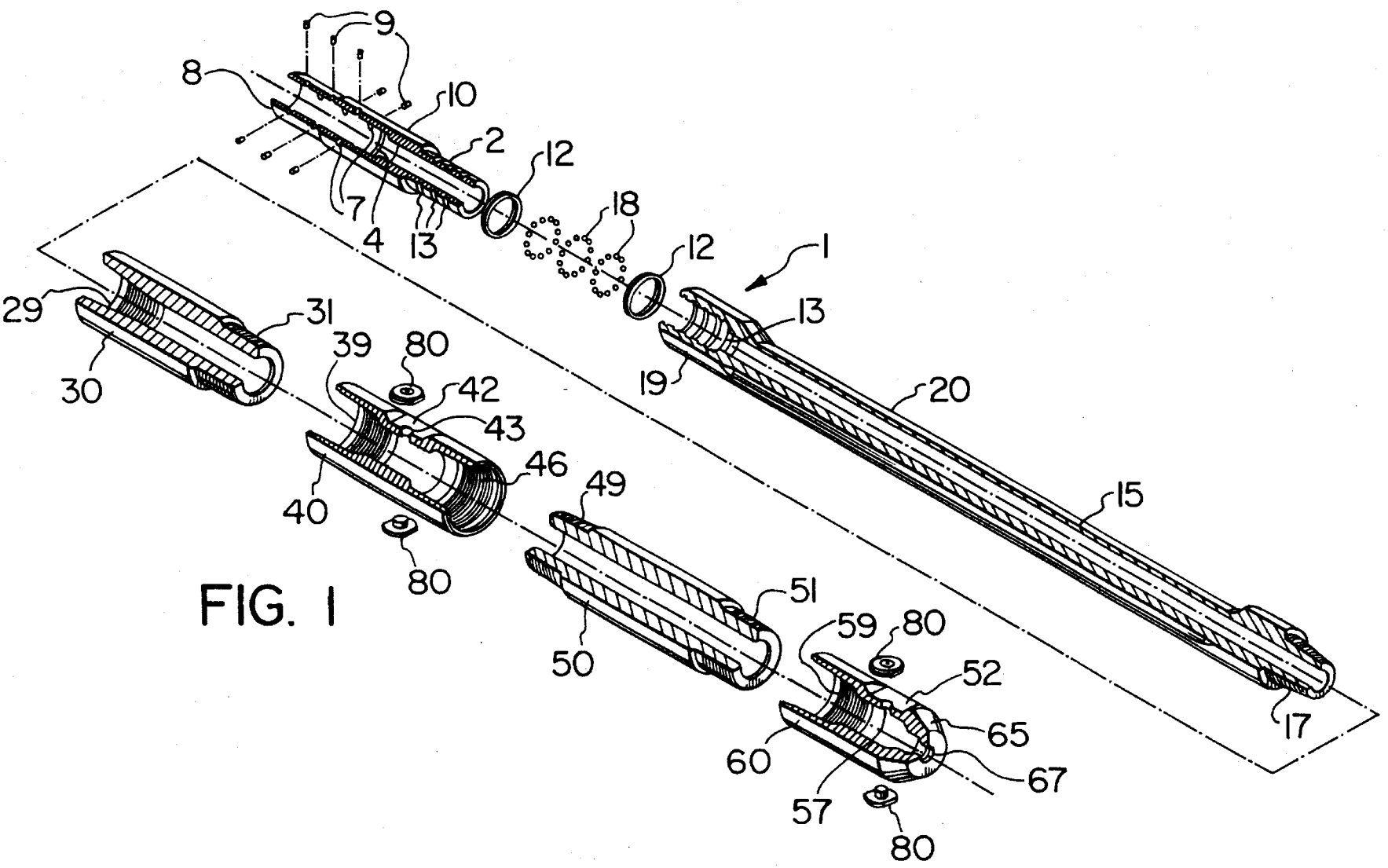
FIG. 1 is a perspective, partially sectional exploded view of a jet sub for erosive stimulation of an open hole formation well bore.
Figure 2:
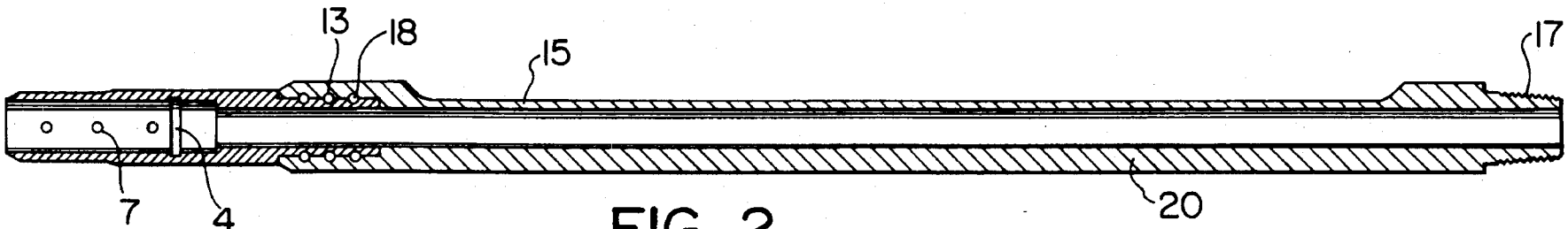
FIG. 2 is a side elevational, cross-sectional view of the top and offset sub portions of the jet sub of FIG. 1.
Figure 3:
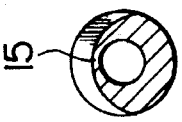
FIG. 3 is a cross-sectional end view of the offset sub of FIG. 2.
Figure 4:
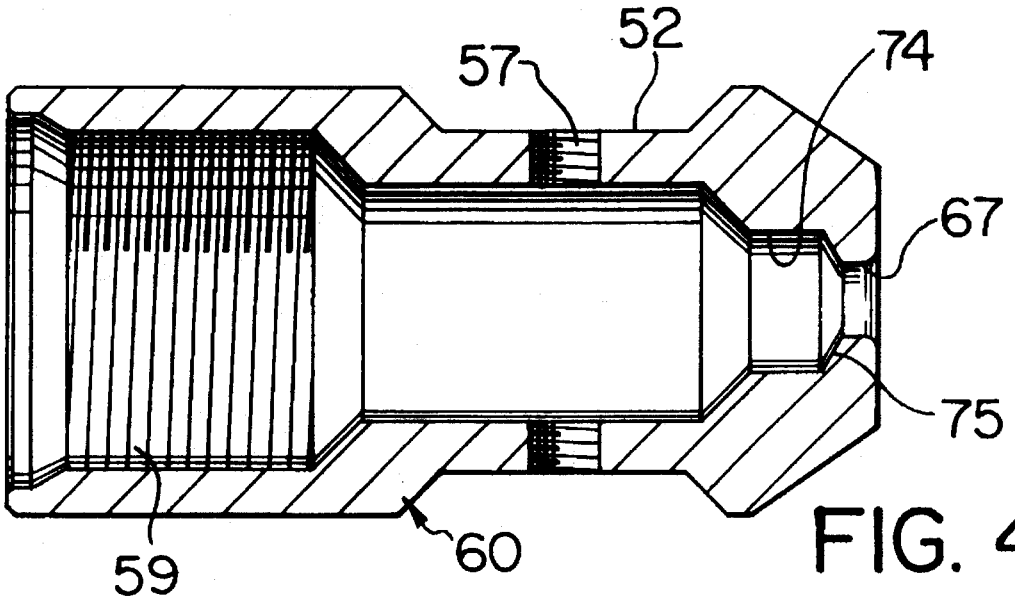
FIG. 4 is a cross-sectional view of a master jet gun body forming part of the tool of FIG. 1.
Figure 5:
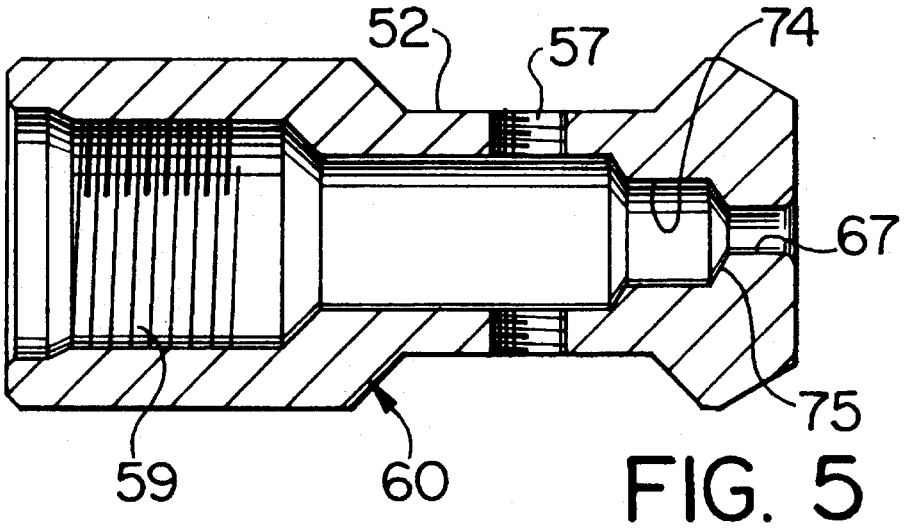
FIG. 5 is a cross-sectional view of an alternate master jet gun body.
Figure 6:
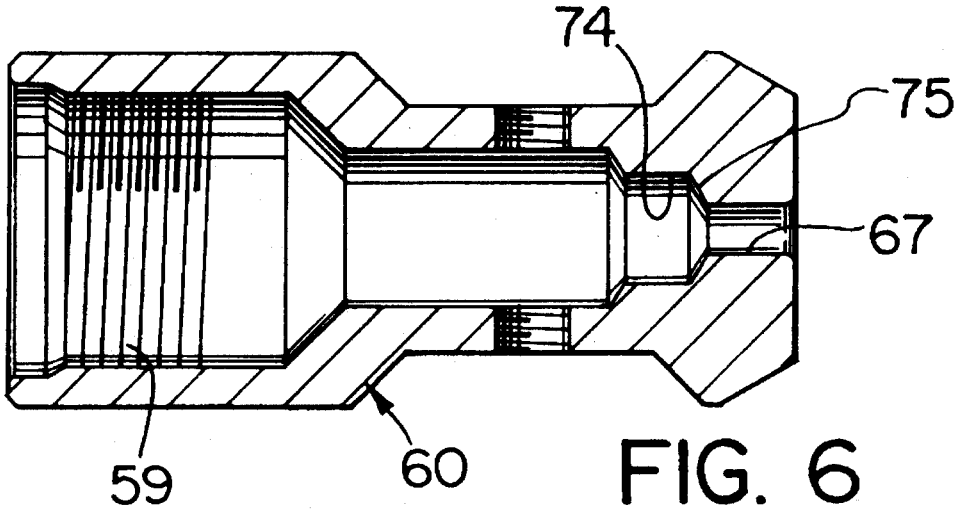
FIG. 6 is a cross-sectional view of yet another master jet gun body.

With reference to FIGS. 1 and 2, applicant's master jet sub (or gun) 1 for abrasive stimulation of an open hole formation generally comprises, proceeding from the uphole to the downhole end thereof, a tubular top sub 10 for connection to the terminus of the coiled tubing (not shown) by means of a plurality of set screws 9, an asymmetrical tubular offset or weighted sub 20 freely rotatably connected at its uphole end 19 to top sub 10 by means of ball bearings 18, a tubular cross-over sub 30, a tubular pumpthrough sub 40, a tubular extension sub 50 and a tubular master jet 60.

Top sub 10 is externally buttress-threaded at its uphole end 8 and is formed with a plurality of longitudinally and radially spaced apart threaded apertures 7 for set screws 9. An annular groove 4 in the sub's interior surface is provided for an O-ring and a back-up ring (not shown) to seal against the tubing. The downhole end 2 of the top sub is narrowed for concentric insertion into the uphole end 19 of weighted sub 20 and is formed with several spaced apart circumferential grooves which align with cooperating and oppositely extending grooves in end 19 of sub 20 to form races 13 for ballbearings 18. Each race 13 is accessed for insertion of bearings 18 by a threaded aperture and cap screw (not shown). Fluid sealing on opposite sides of races 13 is provided by a pair of polypak seals 12.

As will be appreciated, weighted sub 20 is freely rotatable relative to top sub 10 by virtue of bearings 18 which allows the offset to orient itself in horizontal or off-vertical sections of bore by virtue of its "bottom heavy" asymmetry as best seen in FIG. 2. This asymmetry is achieved in the embodiment as shown simply by a thinning of the sub's "upper" annulus or surface 15. The ability of the weighted sub to self-orient is useful in view of the difficulty of achieving proper orientation otherwise in an offset well bore particularly as the ability to reliably dial in small adjustments from the surface through a considerable length of flexible (and twistable) coiled tubing is limited at best.

Moreover, the swivel connection between the top and offset subs prevents transmission of torque into and up the coiled tubing that might occur as a result of turning or spinning of the master jet caused for example by unbalanced discharge of fluid through the jet's nozzles. Particularly when stimulating vertical sections of open well bore the weighted sub can be eliminated.

The downhole end 17 of sub 20 is externally box-threaded for union with the corresponding internally threaded uphole end 29 of cross-over sub 30. Downhole end 31 of the crossover is externally threaded for torqued connection to the correspondingly internally threaded uphole end 39 of pumpthrough sub 40. As best seen from FIG. 1, sub 40 includes a pair of radially opposed machined facets 42 each of which is provided with a central aperture 43 for torqued threaded connection of abrasive jet nozzles 80.

Figure 7:
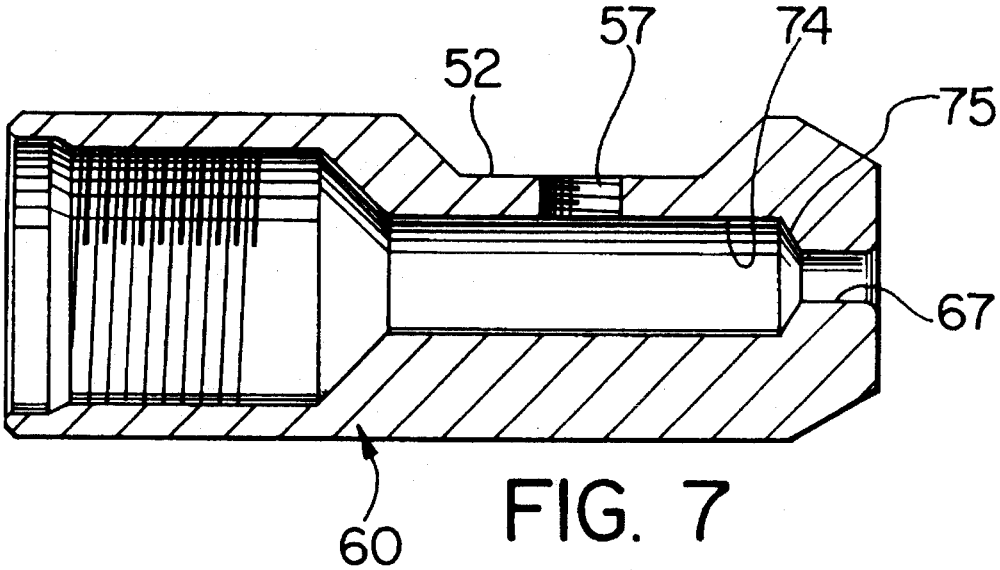
FIG. 7 is a cross-sectional view of yet another master jet gun body having three jet nozzles.
Figure 8:
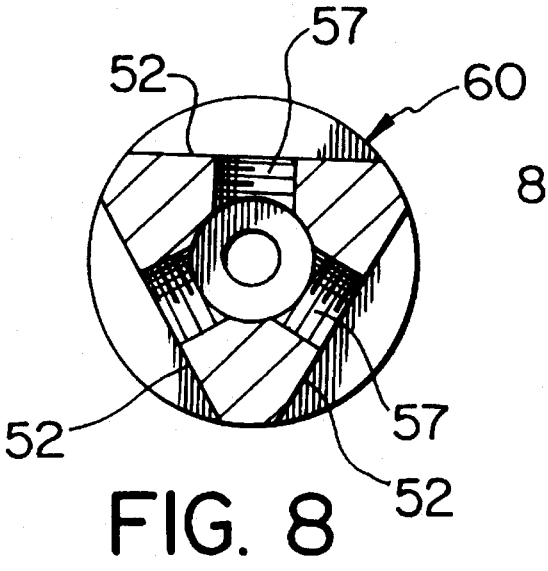
FIG. 8 is a cross-sectional view of the gun body of FIG. 7 taken along the line X—X'.

The downhole end 46 of pumpthrough sub 40 is internally threaded for torqued connection to the correspondingly externally threaded uphole end 49 of extension sub 50. The downhole end 51 of the extension sub is correspondingly threaded for torqued connection to the internally threaded uphole end 59 of master jet 60. The master jet shown in FIG. 1 includes a pair of radially opposed machined facets 52 each having a central aperture 57 formed therein for torqued and threaded connection of abrasive jet nozzles 80. FIGS. 7 and 8 show a modified master jet including three facets 52 spaced at 120° intervals. Other configurations are possible and are within the contemplation of the present invention.

The orientation of nozzles 80 as shown in FIG. 1 is primarily for purposes of clarity of illustration. When used in combination with weighted sub 20, nozzles 80 more typically will be rotated 90° to point to the sides and not up and down as shown. Debris will therefore fall beneath the nozzles and not directly in the path of cutting.

The downstream end 65 of the master jet is tapered to assume a frusto-conical shape and includes a central aperture 67 which facilitates insertion of the tubing into the well bore by allowing flow through and minimum displacement of well bore fluids. Preferably, aperture 67 is sealed during operations to prevent further discharge therethrough as will be described below.

The internal and external geometries and dimensions of the master jets can vary considerably and a few different examples are shown with reference to FIGS. 4 to 8 which illustrate both two and three-nozzle configurations (exclusive of nozzles 67). Like reference numerals have been used to identify like elements as already described hereinabove. Standoff distances between nozzles 80 and the formation wall can be varied by varying the outer diameters of either or both pumpthrough sub 40 and jets 60.

It will be seen that in each master jet, a seat 74 with a bevelled rim 75 is formed immediately upstream of nozzle 67. A steel or rubber ball of appropriate diameter pumped through the coiled tubing (not shown) and master jet sub 1 will seal into the seat to block all further discharge through nozzle 67 under normal operating conditions.

Figure 9:
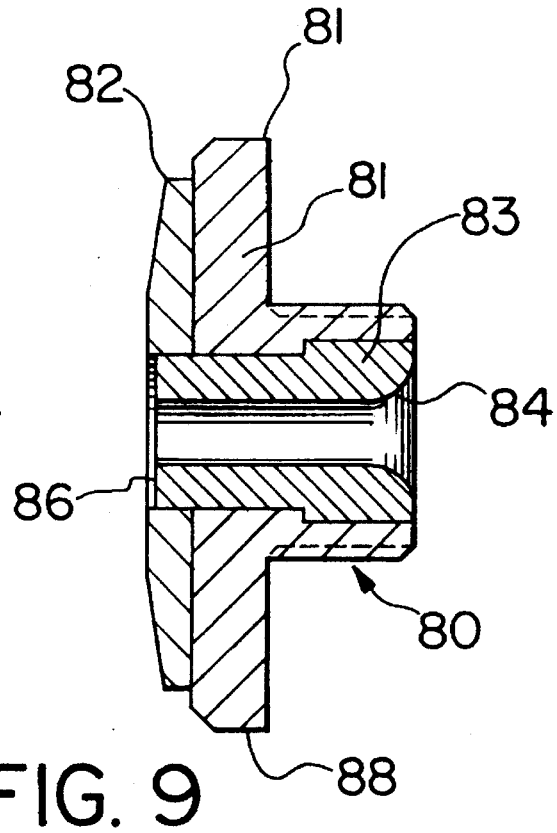
FIG. 9 is a cross-sectional view of an abrasive jet nozzle as used on the jet guns of FIGS. 4 to 8.

With reference now to FIG. 9, abrasive jet nozzles 80 comprise an externally threaded bushing 81, a hollow annular insert 83 having a rounded inlet 84 and a top plate 82 connected to both the bushing and the insert. Plate 82 includes an apertured disk 86 for directed discharge of the abrasive fluid. All of these components can be brazed together. Bushing 81 includes radially opposed facets 88 to facilitate torqued connection to apertures 57.

The structure of nozzles 80 as described herein is intended to be exemplary and other nozzle structures may occur to those skilled in the art.

The combination of elements as described herein is exemplary in nature. For example, weighted sub 20 can be eliminated particularly in vertical sections of open well bore but also in horizontal sections if so desired. Subs 30 and 50 are useful to facilitate connection between components differently or oppositely threaded and also serve, with their thickened and hardened walls, as blast joints resistant to the potentially severe erosion caused by backlash of the abrasive laden jet stream against the gun body. These components can be eliminated however if sub 40 and jets 60 are threaded for direct consecutive connection. Moreover, sub 40 can also be deleted particularly if pressure losses through a long string of tubing leaves insufficient residual pressure to effectively drive more than 2 or 3 nozzles 80. In all events, subs 40 and 60 are usefully hardened to further minimize gun body erosion.

Figure 10:
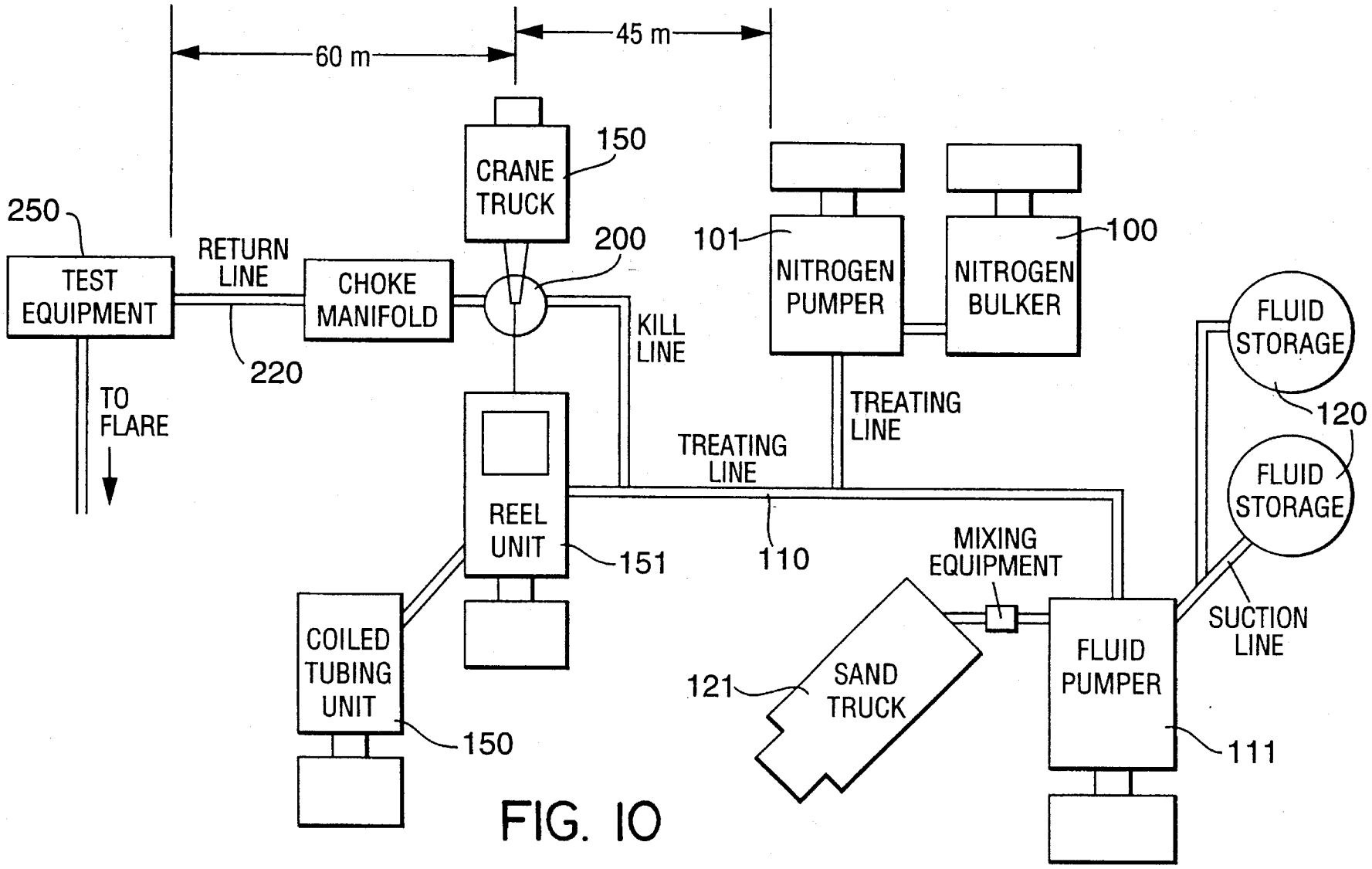
FIG. 10 is a schematical plan view of the surface equipment and location setup for the present method and apparatus.

With reference to FIG. 10, there is shown schematically a typical location setup for the surface equipment used in conjunction with the present invention. The surface equipment is conventional in nature and the setup will be self-evident from the drawing.

Nitrogen from nitrogen bulker 100 is pressured up by nitrogen pumper 101 for admixture to the pressurized sand/water mixture in treating line 110 from fluid reservoirs 120, sand truck 121 and fluid pumper 110. A conventional coiled tubing setup consisting of a tubing unit 150, a reel unit 151 and a crane truck 152 deployed around wellhead 200 inject and remove the coiled tubing in and out of the well bore. The returns from the well bore during treatment flow through return line 220 for monitoring by means of appropriate test equipment 250.

In operation, jet sub 1 is preferably positioned to be pulled rather than pushed through the zone of selective stimulation which in some instances will have been previously cleaned out with water and/or nitrogen. A mixture of sand, water and nitrogen (or some other non-reactive gas) is then pumped into and through the jet sub at rates determined empirically having regard to the nature of the formation, desired depth of cut and pressure necessary to create an underbalanced pressure differential in the well bore for cleanout and to allow continuous evaluation of the operation. In one test conducted by the applicant, flow rates were established at 0.4 $m^3$/min. of fluid, 20 $m^3$/min. of nitrogen using 100 mesh sand concentrated at the rate of 30 kg/$m^3$ at pump pressures ranging from 21 mPa to 40 mPa (3000 to 5500 psi). The time required for the abrasive jet to initiate a cut will vary depending upon formation content as will the rate of cut following cut initiation. Pressures in the tubing string tend to drop following initiation of the cut. Creating an underbalanced condition using nitrogen (or some other gas) allows constant monitoring of the cuttings as well as well bore conditions. In the absence of weighted sub 20, the path of cut will tend to be helical based on experience thus far with cut widths ranging from 1.25 to 2.5 cm to depths of 18 to 25 cm from an approximately 16 mm stand off and using 4.76 mm nozzles. Near-straight trajectories are achieved with use of sub 20. As will be appreciated, the cuts whether straight or curved will be in the nature of long narrow grooves through the treatment zones. These figures are subject to significant variation depending upon pump pressure, formation characteristics, the nature of the abrasive and numerous other factors as will be apparent to those skilled in the art. The rate at which the cut can be extended following initiation also varies considerably subject to downhole conditions but sustainable rates of approximately 75.0 mm/min. are apparently readily obtainable. Moreover, the rate at which the gun is moved past the formation being treated must be such that the orientation of the nozzles 80 remains relatively stable to maintain continuity in the cutting operation and in the cut itself.

The above-described embodiments of the present invention are meant to be illustrative of preferred embodiments of the present invention and are not intended to limit the scope of the present invention. Various modifications, which would be readily apparent to one skilled in the art, are intended to be within the scope of the present invention. The only limitations to the scope of the present invention are set out in the following appended claims.

We claim:

1. A method of treating a section of unlined well bore comprising the steps of:

establishing a flow path through tubular means from the top of the well bore to a location opposite the section of unlined well bore to be treated;

pumping an erosive fluid through said flow path at a predetermined rate and pressure;

directing a stream of said erosive fluid against a surface of said section of well bore to be treated to cause the initiation of a cut thereinto; and moving said stream of said erosive fluid past said surface to be treated to extend the cut formed therein in the direction of movement of said stream, said erosive fluid including a non-reactive gas therein in sufficient predetermined quantity to create an under balanced condition in said well bore.

2. The method of claim 1 wherein said erosive fluid includes a mixture of liquid and particulates adapted to erosively penetrate the surface of said well bore when directed thereagainst under pressure.

3. The method of claim 2 including directing multiple streams of said erosive fluid against a surface of said well bore to be treated.

4. The method of claim 3 wherein said fluid is water.

5. The method of claim 4 wherein said particulates comprise particles of sand.

6. The method of claim 5 wherein said non-reactive gas is nitrogen.

7. Apparatus adapted for connection to non-rotating coiled tubing for erosive cutting of an unlined section of a well bore requiring treatment, comprising:

a tubular member connectable at one end thereof to coiled tubing and having at an opposite end thereof an opening for the passage of fluid;

nozzle means provided on said tubular member for directing a pressurized erosive medium against a surface of a well bore for cutting into said surface, said nozzle means being arranged to avoid reactive forces causing said tubular member to rotate;

means for moving said tubular member past a section of well bore requiring treatment such that said erosive medium forms a cut thereinto in the direction of movement of said tubular member; and means for sealing said opening in said tubular member during flow of said pressurized erosive medium through said nozzles.

8. The apparatus of claim 7, wherein said means for sealing comprise a spherical member movable through said coiled tubing, said spherical member being adapted for selective sealing of said opening in said tubular member.

9. Apparatus for abrasively jetting portions of an unlined well bore to form cuts therein, said apparatus comprising:

a first tubular member adapted at an uphole end thereof for connection to a tubing string;

tubular sub means rotatably connectable at an uphole end thereof to said first tubular member, said tubular sub means adapted to assume due to gravity a predetermined orientation in a non-vertical section of well bore;

tubular means connectable to said apparatus downhole and in axial alignment with said tubular sub means to be non-rotatable relative thereto; and nozzle means provided on said tubular means for directing one or more pressurized abrasive jets against a surface of an unlined well bore to initiate a cut therein, wherein, by moving said apparatus past a predetermined length of said well bore while directing said pressurized jets thereagainst, a continuous cut can be formed in said surface in the direction of movement of said apparatus.

10. The apparatus of claim 9 wherein said tubular sub means are unequally weighted on opposite sides of the longitudinal transverse medial plane thereof to facilitate self-orientation of said tubular sub means in non-vertical sections of a well bore.

11. The apparatus of claim 10, wherein said tubular means include an aperture through the downhole end thereof to provide fluid communication between the interior of said apparatus and the tubing string connected thereto and the annulus between said apparatus and tubing string and said well bore.

12. The apparatus of claim 11 wherein said aperture is adapted to be sealed by means of a ball member movable through said tubing string and said apparatus for sealing engagement in seat means provided in said tubular means adjacent an inner end of said aperture.

13. The apparatus of claim 12 wherein said tubular means are connectable to said tubular sub means via an intermediary axially aligned second tubular member.

14. The apparatus of claim 13 wherein said tubular means comprise a first tubular pumpthrough sub and tubular master jet means, each of said pumpthrough sub and said master jet means including said nozzle means provided thereon, said nozzle means being arranged to avoid reactive forces causing said tubular member to rotate as said pressurized abrasive jets are directed against said well bore.

* * * * *